US007544100B2

(12) United States Patent
Teitelbaum

(10) Patent No.: US 7,544,100 B2
(45) Date of Patent: Jun. 9, 2009

(54) EXPANDABLE ELECTRICAL PLUG AND SURGE PROTECTOR

(76) Inventor: Yekusiel Teitelbaum, 5416 New Utreicht Ave., Brooklyn, NY (US) 11219

( * ) Notice: Subject to any disclaimer, the term of this patent is extended or adjusted under 35 U.S.C. 154(b) by 0 days.

(21) Appl. No.: 12/002,818

(22) Filed: Dec. 19, 2007

(65) Prior Publication Data

US 2008/0150357 A1 Jun. 26, 2008

Related U.S. Application Data

(60) Provisional application No. 60/871,163, filed on Dec. 21, 2006, provisional application No. 60/885,244, filed on Jan. 17, 2007, provisional application No. 60/885,245, filed on Jan. 17, 2007, provisional application No. 60/958,575, filed on Jul. 6, 2007.

(51) Int. Cl.
*H01R 25/00* (2006.01)

(52) U.S. Cl. ..... 439/652

(58) Field of Classification Search ..... 439/650, 439/652, 211, 219, 535; 174/57, 58, 60, 174/350; 361/736
See application file for complete search history.

(56) References Cited

U.S. PATENT DOCUMENTS

| | | | | |
|---|---|---|---|---|
| 5,596,174 | A | 1/1997 | Sapienza | |
| D421,741 | S | 3/2000 | Lien | |
| 6,036,525 | A | 3/2000 | Alfis, III | |
| D445,405 | S | 7/2001 | Schneider et al. | |
| 7,186,146 | B1 * | 3/2007 | Chang et al. | 439/650 |
| 7,393,250 | B2 * | 7/2008 | Tanaka | 439/652 |
| 2001/0027066 | A1 | 10/2001 | Loh | |
| 2007/0032106 | A1 | 2/2007 | Lichtscheidl et al. | |

* cited by examiner

*Primary Examiner*—Alexander Gilman
(74) *Attorney, Agent, or Firm*—James Ray & Associates

(57) ABSTRACT

A combination expandable outlet and surge protector apparatus includes a plurality of outlet plugs which are separately moveable and are protected by a water impervious sheathing attached to each plug and at least one surge protector circuit. The apparatus can either be engaged with the wall outlet or as a extension type outlet. The preferred embodiment includes an on/off switch and an indicator lamp that is illuminated when the plurality of outlets are energized.

19 Claims, 4 Drawing Sheets

EXPANDABLE ELECTRICAL PLUG AND SURGE PROTECTOR

CROSS REFERENCE TO RELATED APPLICATION

This application is related to and claims priority from Provisional Patent Application Ser. No. 60/871,163 filed Dec. 21, 2006, Provisional Application No. 60/885,244 filed Jan. 17, 2007, Provisional Application 60/885,245 filed Jan. 17, 2007 and Provisional Patent Application Ser. No. 60/958,575 filed on Jul. 6, 2007.

Application Ser. No. 11/728,861 is copending and is incorporated by reference herein.

FIELD OF THE INVENTION

The present invention relates, in general, to electrical wall outlets and electrical cords having at least one plug connection for plugging an electrically operated device into and, more particularly, this invention relates to an expandable electrical plug connector for plugging a plurality of such electrically operated devices therein with surge protection.

BACKGROUND OF THE INVENTION

Prior to the conception and development of the present invention, as is generally well known in the art, electrical wall plugs and extension cords have been in widespread use to provide power to electrical devices.

As is equally well recognized, these electrical wall plugs and extension cords have outlets which are oftentimes spaced relatively close together. Such closely spaced outlets can make it quite difficult at times to plug in more than one device at a time in some wall outlets and/or extension cords because the outlets are normally spaced relatively close together. This is particularly the case with certain types of plugs attached to the device. These plugs come in a large variety of sizes and shapes. Examples of these devices at least include, but are not limited to, kitchen appliances, lamps, audio equipment, television, radio, alarm clocks, electric razors, hair dryers, computers, monitors, printers, etc.

Even if one is able to plug more than one plug into an electrical outlet it may be quite difficult to remove the plug due to their close proximity to one another. Although in building a new structure such as a home or commercial building it is possible to provide sufficient outlets to alleviate the above identified problem it is not likely that a building will be rewired just for this problem alone.

SUMMARY OF THE INVENTION

The present invention provides an electrical outlet apparatus equipped to receive power from an electrical receptacle of a wall outlet power source. The present invention combines the invention described in the copending application mentioned above with at least one surge protection circuit and water impervious sheathing between a plurality of outlets. In the preferred embodiment the sheathing folds and unfolds in an accordion type pattern. The electrical outlet apparatus includes a predetermined plurality of outlets capable of extending a predetermined distance apart for distributing a power input from such wall outlet power source to at least one pre-selected object electrically connected to one of such predetermined plurality of outlets. The electrical outlet apparatus includes a first means engageable in and electrically connected to such wall outlet power source for supplying power to such apparatus. A predetermined number of electrical plug receptacles are arranged in a predetermined pattern and are electrically connected to receive electrical power from such first electrical plug receptacle engaged in such wall outlet power source. There is a second means engageable at a predetermined location with each of such predetermined number of electrical plug receptacles for spacing them a predetermined distance apart to facilitate insertion and removal of plugs attached to such pre-selected objects. Such second means is capable of expanding and retracting the predetermined number of such electrical plug receptacles.

OBJECTS OF THE INVENTION

It is, therefore, one of the primary objects of the present invention to provide an electrical outlet apparatus having a predetermined number of outlets to receive an electrical plug therein which is capable of being arranged in a predetermined manner.

Another object of the present invention is to provide an electrical outlet apparatus having a predetermined number of outlets to receive an electrical plug therein which enables the outlets to be spaced apart to facilitate insertion and removal of electrical plugs attached to preselected objects.

Still another object of the present invention is to provide an electrical outlet apparatus having a predetermined number of outlets to receive an electrical plug therein which can be produced in designer colors.

Yet another object of the present invention is to provide an electrical outlet apparatus having a predetermined number of outlets to receive an electrical plug therein which can be produced as an extension cord type device.

An additional object of the present invention is to provide an electrical outlet apparatus having a predetermined number of outlets to receive an electrical plug therein which is relatively easy to use.

A further object is to provide surge protection for an expandable electrical outlet apparatus.

Another object is to provide sheathing impervious to water for an expandable electrical apparatus.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
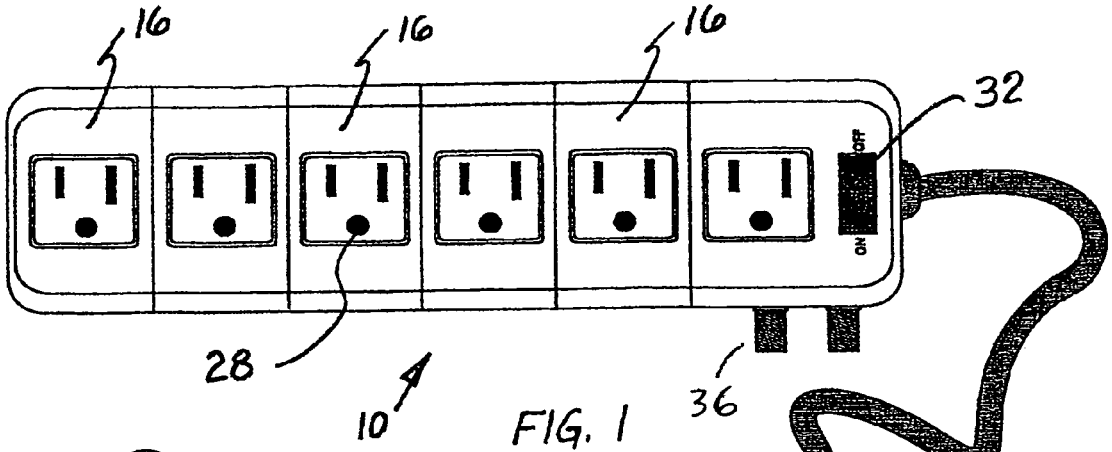
FIG. 1 is a plan view of a combination surge protector with plurality of electrical outlets.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Reference is now made, more particularly, to FIGS. 1-6. Illustrated therein are the presently preferred and a number of alternative embodiments of an electrical outlet apparatus, generally designated 10 in FIGS. 1 and 2 and generally designated 20 in FIGS. 3-6, equipped to receive power from an electrical receptacle of a wall outlet power source 11. The embodiments have an overvoltage suppression circuit of a commonly used type (not shown) including for example a thrysistor, varistor, or gas discharge tube.

Figure 2:
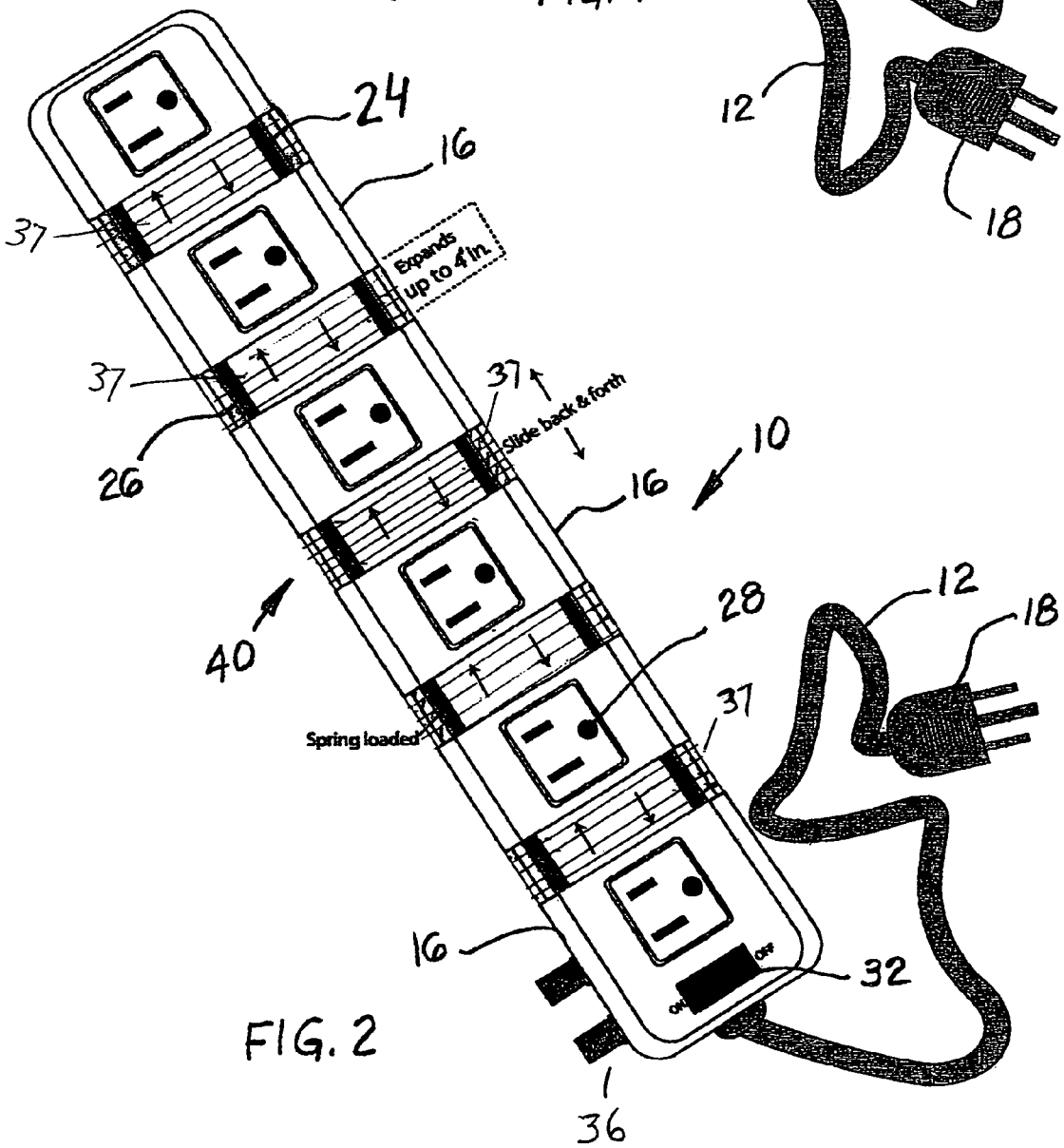
FIG. 2 is a plan view of the extension cord type combination device having a plurality of electrical outlets illustrated in FIG. 1 and shown in an open position with the sheathing transparent to partially reveal the structure inside.
Figure 3:
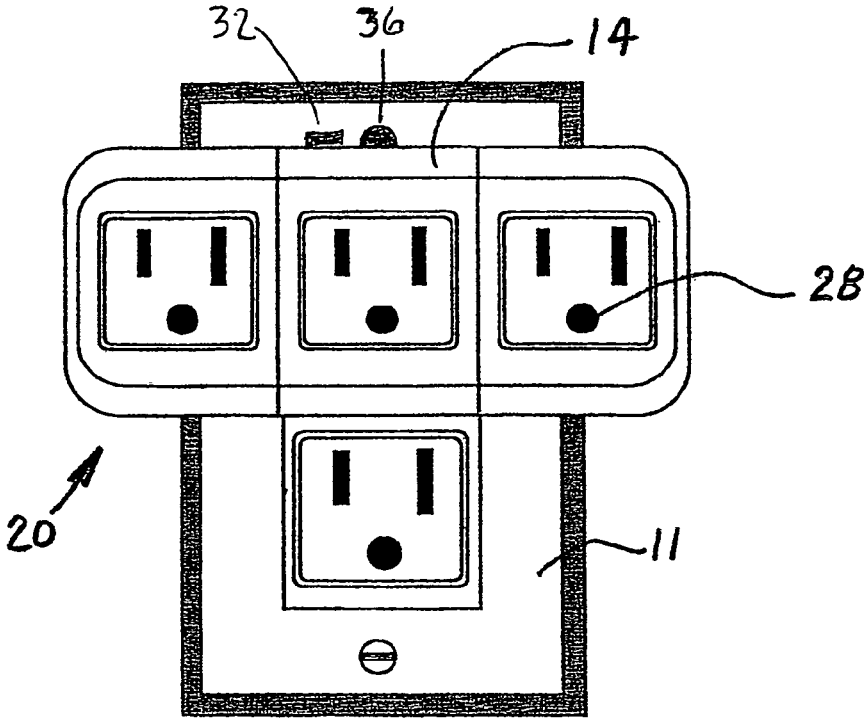
FIG. 3 is a plan view of a combination surge protector and electrical receptacle engageable in a wall outlet produced according to the present invention and shown in a closed position.
Figure 4:
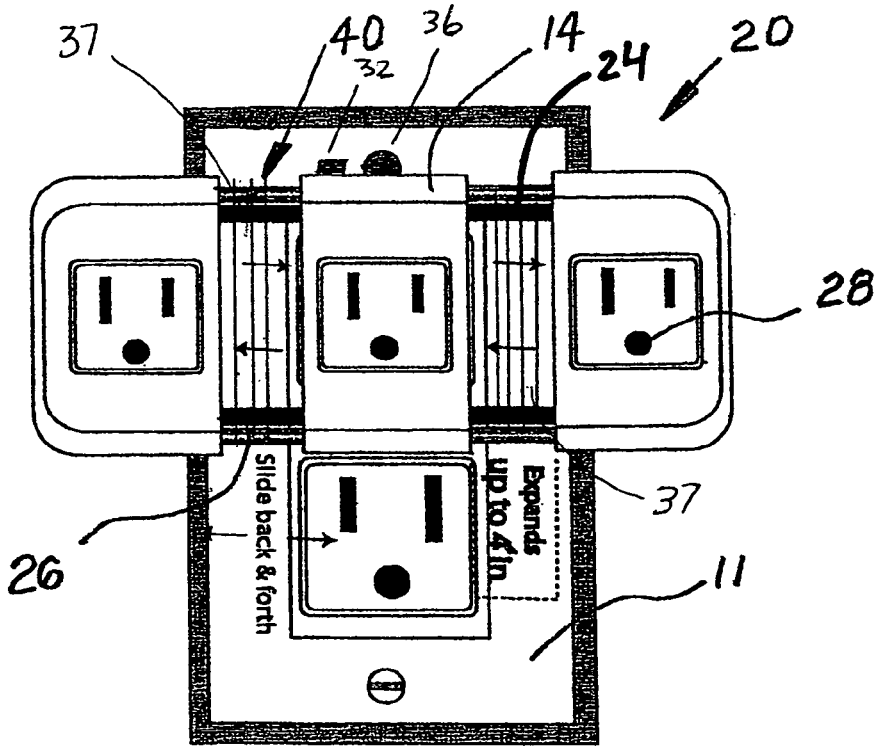
FIG. 4 is a plan view of the combination electrical receptacle and surge protector engageable in a wall outlet illustrated in FIG. 3 and shown in an open position with the sheathing transparent to partially reveal the structure inside.
Figure 5:
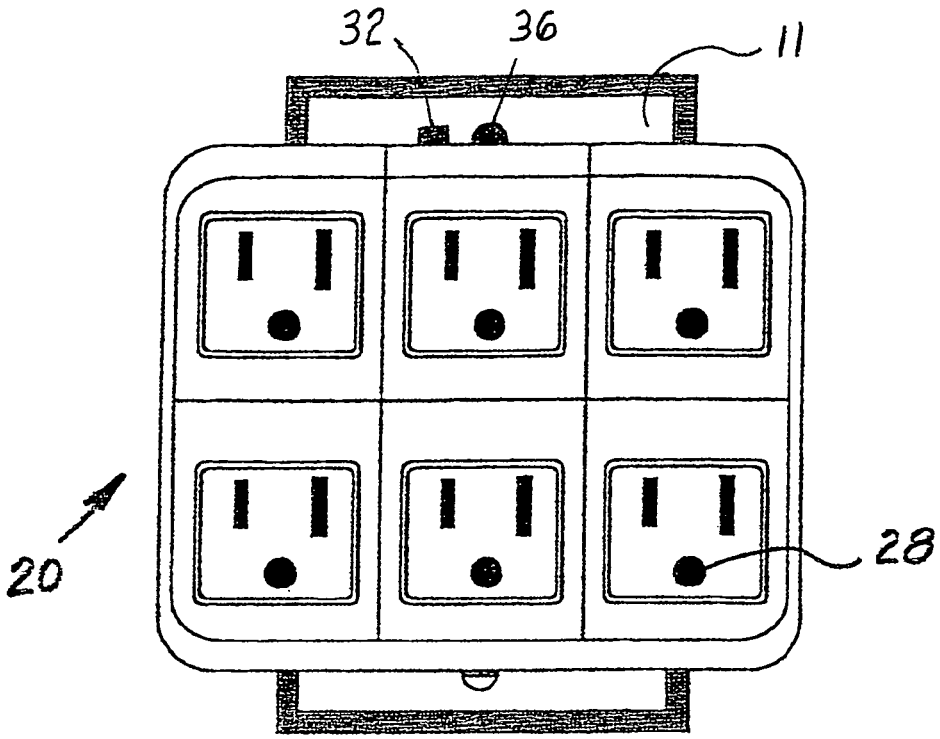
FIG. 5 is a plan view of an alternative embodiment of an combination electrical receptacle engageable in a wall outlet produced according to the present invention and shown in a closed position.
Figure 6:
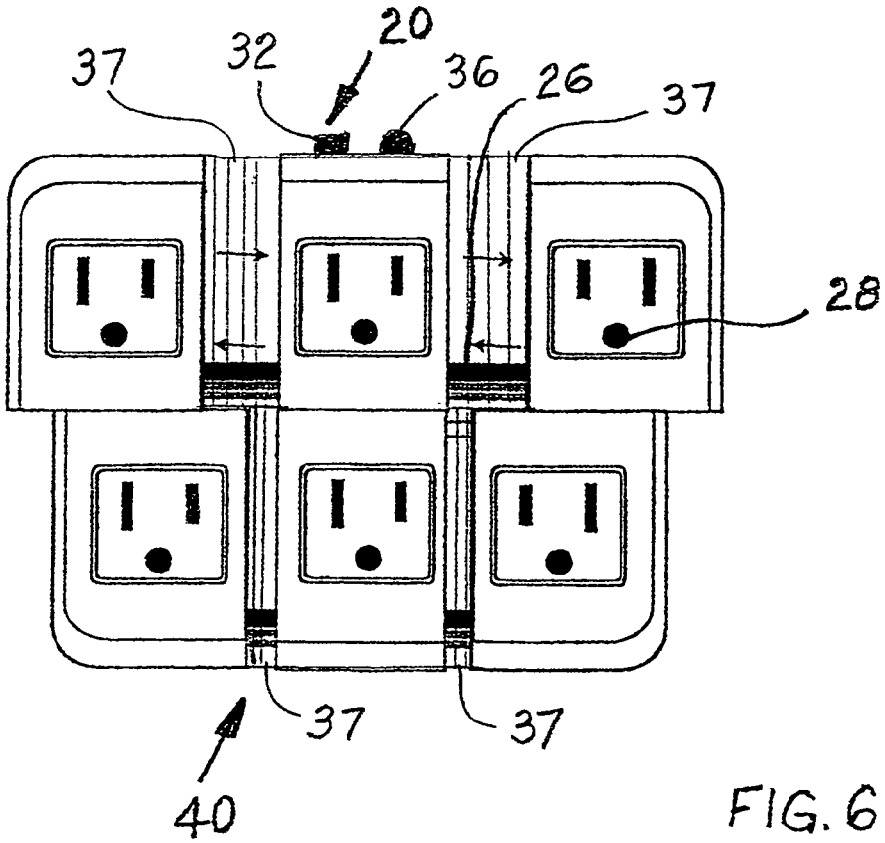
FIG. 6 is a plan view of the combination electrical receptacle and surge protector engageable in a wall outlet illustrated in FIG. 5 and shown in an open position with the sheathing transparent to partially reveal the structure inside.
Figure 7:
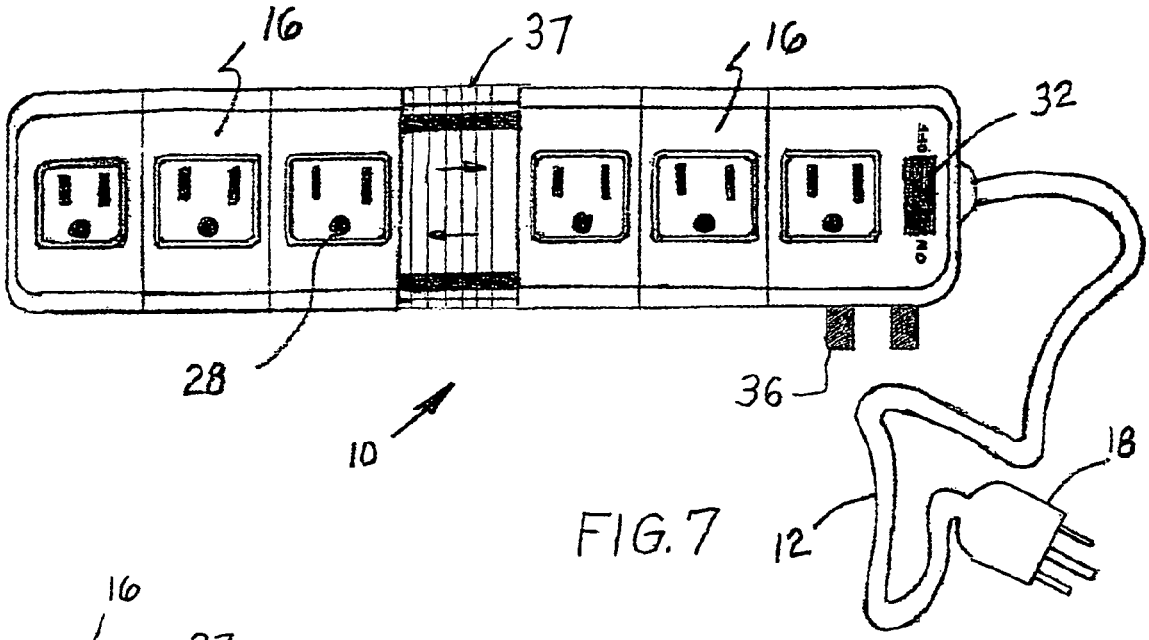
FIG. 7 is a plan view of the combination electrical receptacle illustrated in FIG. 1 in a selectively open position with the sheathing transparent to reveal the structure inside.
Figure 8:
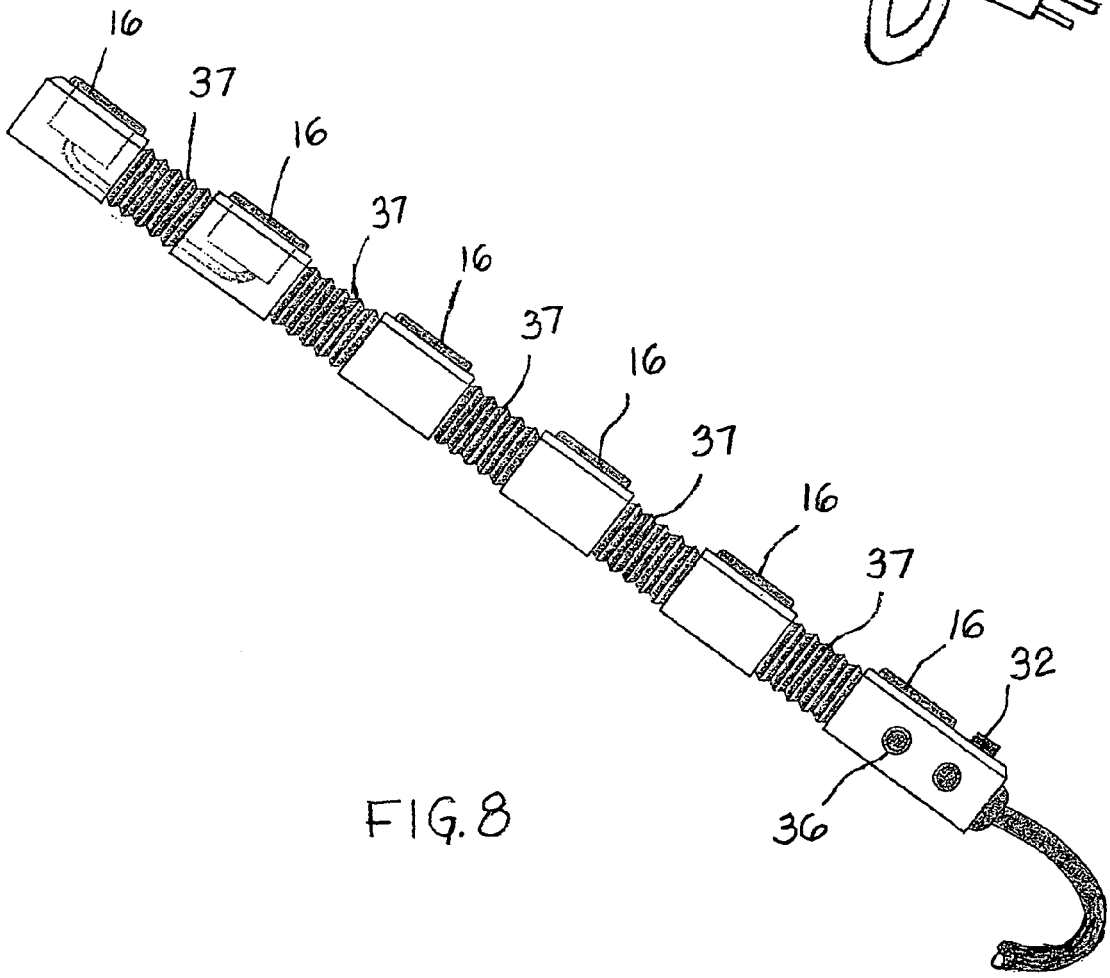
FIG. 8 is a side view of the combination electrical receptacle and surge protector illustrated in FIG. 1.

In FIGS. 1 and 2, the apparatus 10 is illustrated as an extension cord 12 whereas in FIGS. 3-6 the apparatus 20 is illustrated as a wall plug 14.

In either case, such electrical outlet apparatus 10, 20 has a predetermined plurality of outlets 16 capable of extending a predetermined distance apart for distributing a power input from such wall outlet power source to at least one pre-selected object (not shown) electrically connected to one of such predetermined plurality of outlets 16. The outlets in have a sheathing 37 of material impervious to water and are attached to the sides of the outlets 16 to protect the apparatus from moisture and the elements. Preferably the sheathing 37 is arranged in a folded accordiant type pattern to unfold and fold as the outlets 16 are expanded.

The electrical outlet apparatus 10, 20 will include a first means, generally designated 30, which is engageable in and electrically connected to such wall outlet power source for supplying power to such apparatus 10, 20. In the case of the extension cord 12, such first means 30 is a plug 18.

There are a predetermined number of electrical plug receptacles 16, arranged in a predetermined pattern, which are electrically connected to receive electrical power from such first electrical plug receptacle 16 engaged in such wall outlet power source 11. In the case of the apparatus 20, such first means 30 is one of such predetermined number of electrical plug receptacles 16 that can be plugged into such wall outlet power source 11.

A second means, generally designated 40, engageable at a predetermined location with each of such predetermined number of electrical plug receptacles 16 for spacing them a predetermined distance apart to facilitate insertion and removal of plugs (not shown) attached to such pre-selected objects (not shown). Such second means 40 is capable of expanding and retracting the predetermined number of said electrical plug receptacles 16.

In the presently preferred embodiment of the invention such predetermined distance such electrical plug receptacles 16 are spread apart is generally up to about 4.0 inches. Additionally, the second means 40 includes retaining means 24 for retaining such receptacles 16 apart and a retraction means 26 for retracting such receptacles 16. Such retraction means 26 is preferably a spring and specifically a tension spring.

In the present invention there will be at least three receptacles 16. More preferably there will be between three and six receptacles 16. The presently preferred predetermined pattern is one of linear and a pattern containing at least one row and at least one column of receptacles.

Further, in the presently preferred embodiment for both the apparatus 10 and 20 each of the receptacles 16 will preferably include a ground 28. Also, the extension cord 12 and the wall type plug includes an on/off type switch 32. The apparatus has a lamp 36 located operably connected to switch 32 to indicated that the outlets are energized when switch 32 is in the on position.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. A combination electrical outlet and surge protector electrical outlet apparatus equipped to receive power from an electrical receptacle of a wall outlet power source, said electrical outlet apparatus having a predetermined plurality of outlets capable of extending a predetermined distance apart for distributing a power input from such wall outlet power source to at least one pre-selected object electrically connected to one of said predetermined plurality of outlets, said electrical outlet apparatus comprising:

(a) a first means engageable in and electrically connected to such wall outlet power source for providing power to said electrical outlet apparatus;

(b) a predetermined number of electrical plug receptacles, arranged in a predetermined pattern, electrically connected to receive electrical power from said first means engaged in such wall outlet power source; and (c) a second linear means at a predetermined location engageable with each of said predetermined number of said electrical plug receptacles for spacing said electrical plug receptacles at a predetermined distance apart to facilitate insertion and removal of plugs attached to such pre-selected objects, said means capable of expanding and retracting each of said predetermined number of said electrical plug receptacles, (d) at least one surge protecting circuit between said first means electrically connected engageable in and electrically connected to such wall outlet power source and said predetermined number of plug receptacles.

2. A combination electrical outlet and surge protector apparatus according to claim 1, wherein said predetermined number of electrical plug receptacles is at least three.

3. A combination electrical outlet and surge protector apparatus according to claim 1, wherein said predetermined number of electrical plug receptacles is between about three and six.

4. A combination electrical outlet and surge protector apparatus according to claim 1, wherein each of said receptacles include a ground.

5. A combination electrical outlet and surge protector apparatus according to claim 1, wherein said predetermined pattern includes moving any predetermined number of said electrical plug receptacles apart while leaving others together.

6. A combination electrical outlet and surge protector apparatus according to claim 1 wherein a water impervious sheathing means is fixably attached between each of said predetermined number of plug receptacles.

7. A combination electrical outlet and surge protector apparatus according to claim 6 wherein said water impervious sheathing is folded and unfolded in an accordian pattern.

8. A combination electrical outlet and surge protector according to claim 1 wherein an on/off switch is disposted between said first means and said surge protector circuit to operably energize and deenergize said plug receptacles.

9. A combination electrical outlet and surge protector according to claim 8 wherein an indicator lamp is operably connected to said switch so that said lamp is illuminated when said switch is in the on position.

10. A combination electrical outlet and surge protector apparatus according to claim 8, wherein said predetermined pattern includes moving any predetermined number of said electrical plug receptacles apart while leaving others together.

11. A combination electrical outlet and surge protector apparatus according to claim 1, wherein said apparatus is formed as one of an extension cord type device and a wall plug type device.

12. A combination electrical outlet and surge protector apparatus according to claim 11, wherein said predetermined distance said electrical plug receptacles are spread apart is generally up to about 4.0 inches.

13. A combination electrical outlet and surge protector apparatus according to claim 11, wherein said predetermined pattern is linear.

14. A combination electrical outlet and surge protector apparatus according to claim 11, wherein said predetermined pattern includes at least one row and at least one column of receptacles.

15. A combination electrical outlet and surge protector apparatus according to claim 11, wherein said predetermined pattern includes moving any predetermined number of said electrical plug receptacles apart while leaving others together.

16. A combination electrical outlet and surge protector apparatus according to claim 11 wherein said second means includes retaining means for retaining said receptacles apart and a retraction means for retracting said receptacles.

17. A combination electrical outlet and surge protector apparatus according to claim 16, wherein said retraction means is a spring.

18. A combination electrical outlet and surge protector apparatus according to claim 17, wherein said spring is a tension spring.

19. An electrical outlet apparatus equipped to receive power from an electrical receptacle of a wall outlet power source, said electrical outlet apparatus having a predetermined distance apart for distributing a power input from such wall outlet power source to at least one pre-selected object electrically connected to one of said predetermined plurality of outlets, said electrical outlet apparatus comprising:

(a) a first means engageable in and electrically connected to such wall outlet power source form providing power to said electrical outlet apparatus;

(b) a predetermined number of electrical plug receptacles, arranged in a predetermined pattern, electrically connected to receive electrical power from said first means engaged in such wall outlet power source; and (c) a second linear means at a predetermined location engageable with each of said predetermined number of said electrical plug receptacles for spacing said electrical plug receptacles at a predetermined distance apart to facilitate insertion and removal of plugs attached to such pre-selected objects, said means for expanding and retracting each of said predetermined number of said electrical plug receptacles, (d) at least one surge protecting circuit between said first means electrically connected engageble in and electrically connected to such wall outlet power source and said predetermined number of plug receptacles, (e) a water impervious sheathing means is fixably attached between each of said predetermined number of plug receptacles;

(f) a switch is disposed between said first means and said surge protector circuit to operably energize and deenergize said plug receptacles; and, (g) an indicator lamp operably connected to said switch and illuminated when said switch is in the on position.

* * * * *